United States Patent [19]

Brotzmann et al.

[11] Patent Number: 4,673,167

[45] Date of Patent: Jun. 16, 1987

[54] METHOD FOR INSTALLING A CONVERTER BOTTOM

[75] Inventors: Karl Brotzmann; Paul-Gerhard Mantey, both of Sulzbach-Rosenberg, Fed. Rep. of Germany

[73] Assignee: Kloeckner CRA Technologie GmbH, Fed. Rep. of Germany

[21] Appl. No.: 892,636

[22] Filed: Sep. 16, 1986

Related U.S. Application Data

[63] Continuation of Ser. No. 696,917, Jan. 31, 1985, abandoned.

[30] Foreign Application Priority Data

Feb. 2, 1984 [DE] Fed. Rep. of Germany ..... 3403490

[51] Int. Cl.[4] ..... C21B 7/04

[52] U.S. Cl. ..... 266/281; 266/283; 266/280

[58] Field of Search ..... 266/44, 280, 281, 283, 266/286; 264/30

[56] References Cited

U.S. PATENT DOCUMENTS

| | | | |
|---|---|---|---|
| 3,262,687 | 7/1966 | Freygang | 266/286 |
| 3,330,546 | 7/1967 | Bryan | 266/286 |
| 3,401,226 | 9/1968 | Renkey | 266/286 |
| 3,429,487 | 2/1969 | Tredennick et al. | 266/283 |

FOREIGN PATENT DOCUMENTS

| | | | |
|---|---|---|---|
| 0070213 | 4/1982 | Japan | 266/280 |

*Primary Examiner*—L. Dewayne Rutledge
*Assistant Examiner*—S. Kastler
*Attorney, Agent, or Firm*—Robert J. Koch

[57] ABSTRACT

This invention relates to a method for installing a converter bottom, using not only bottom bricks of commercial brick formats but also shaped and fitting bricks, the largest area on a bottom plate being lined with bottom bricks of commercial brick formats, leaving a space free. After the bottom has been inserted into the converter, shaped bricks are laid one beside the other in the free edge area adjacent to the converter walling, the sides of these bricks facing the converter walling being fitted to the curvature of the converter walling. These shaped bricks are of a size such that a free space exceeding one joint width remains between each shaped brick and the adjacent bottom brick. Fitting bricks true to dimensions are laid in these free spaces.

21 Claims, 2 Drawing Figures

METHOD FOR INSTALLING A CONVERTER BOTTOM

This is a continuation of application Ser. No. 696,917, filed Jan. 31, 1985, now abandoned.

BACKGROUND OF THE INVENTION

The invention relates to a method for installing a converter bottom, in particular one provided with nozzles for introducing media, and in which the largest area on a bottom plate is lined with bottom bricks of commercial brick formats.

In the case of vessels for receiving molten metal, in particular molten iron, in the bottom of which vessels nozzles are provided for introducing various media into the molten metal, there is known to be a higher degree of wear of the refractory bottom bricks in comparison with the lining of the vessel. For this reason, bottom blowing steel making converters or iron bath reactors for producing gas and corresponding converters for melt reduction, for example, are provided with replaceable vessel bottoms. Such a treatment vessel, generally termed a "converter" here, has a dismountable bottom plate on which the bottom lining is located. The introduction nozzles are built into this refractory bottom lining, and the bottom is replaced by a new one when required, usually when the refractory material is worn down to the safety layer. The space which is left free during the installation of the bottom, i.e. the adjusting joint between the bottom walling and the vessel walling, is filled up with a refractory mass. When the entire converter is relined, this mass is rammed in, and when the bottom is changed in the heated vessel, the joint is filled in with a casting mass. In particular tar- or pitch-bound products on a magnesite and/or dolomite base have proved useful as refractory material for this purpose.

Under favorable operating conditions, at least one change of bottom is necessary during the converter campaign in the case of a steel making converter operated only with bottom nozzles or a combined blowing technique. In a first approximation, wear rates therefore result for the bottom lining which are about twice as high as for the side walling.

The absolute wear of the refractory material, for example in a steel making converter, depends on the operating conditions, in particular on the maximum temperature, usually the tapping temperature of the molten steel. Wear rates of 0.3 to 0.6 mm per charge come about for the vessel lining at an average tapping temperature of 1600° C. in the case of the pitch-bound, low-iron magnesite bricks preferably used today, whereas a wear rate of approx. 1.6 mm per charge occurs at an average tapping temperature of 1680° C. The wear of the bottom bricks is higher by a factor of 2, as already mentioned.

When the stress on the vessel linings increases, i.e. with increasing operating temperatures of the converter, there is further a superproportional degree of wear of the adjusting joint between the vessel bottom and the wall lining, which is lined with ramming or casting mass. Repairs are necessary to counteract premature wear in this area. For this purpose the preliminary worn joint is cast with a pitch-bound mass, as during the change of bottom in the hot vessel. Like the change of bottom itself, these repair measures, along with the subsequent heating and sintering of the casting mass, have a detrimental effect on the availability of the converter. Furthermore, the wear of the joint has an unfavorable effect on the durability of the bottom since the bricks at the edge of the bottom are rounded toward the joint and wear out more quickly than the center of the bottom.

In the past there has been no shortage of attempts to improve the durability of the bottom. Thus, a German Offenlegungsschrift No. 28 43 735 describes a bottom in which only one nozzle is arranged per row of bricks. Further, wider joints up to 2.5% of the maximum brick width are recommended in the bottom walling. However, no success has been achieved with the bottoms according to the teachings of this application. in reducing the wear rates of the bottom bricks to the magnitude of the converter lining in which these bottoms are installed.

German Pat. No. 26 54 232 relates to a method and an apparatus for producing nozzle bottoms for oxygen blowing converters with protection gas tuyères, in which the channels for the nozzles are drilled after the bottom plate has been lined with the bricks. This method allows for older, partly warped bottom plates with dense joints to be lined with the bottom bricks without regard to shaped bricks for the nozzles. However, the bottoms produced according to this method do not eliminate the problem of the premature wear of the adjusting joint between the bottom walling and the converter lining, since the changeable bottoms can on principle only be installed when the converter lining is finished.

SUMMARY OF THE INVENTION

The invention is based on the problem of retaining the advantages of the bottom lining but connecting it with the wall lining of a converter in such a way as to avoid premature wear in the joint between the bottom walling and the side walling, increase the durability of the bottom and thereby improve the availability of the converter by eliminating repair periods.

The solution to this problem lies in lining the edge area of the bottom plate which remains free of bottom bricks towards the converter lining with shaped bricks after the bottom has been inserted into the converter, and inserting fitting bricks true to dimensions between these shaped bricks and the bottom bricks.

The geometry of these shaped bricks is preferably such that a rectangular free space is formed, relative to the bottom plane, between these bricks and the adjacent bottom bricks.

The sides of the shaped bricks facing the bottom bricks are preferably flat. Rectangular bricks are preferably used as bottom bricks.

The space remaining free between the shaped bricks and the adjacent bottom bricks is wider than a desired joint width. The joint widths are preferably between 0.5 and 3 mm and in particular approx. 1 mm. The width of the free space between the shaped bricks and the adjacent bottom bricks is preferably more than 5 mm, in particular more than 10 mm and is usually in the range of 20 to 150 mm.

The dimensions of the fitting bricks are preferably measured at two or even more different heights, since it has been shown that the width of the free spaces varies at different heights. The fitting bricks may be composed of several parts. Thus, one may consider providing several narrow fitting bricks to fill up the free space.

The fitting bricks and the shaped bricks are preferably built in with mortar.

The shaped bricks are adapted on the side facing the converter lining to fit the curvature of the converter lining. The term "fit" does not mean "fit precisely", but only "approximately". This is preferably effected by making the side facing the converter lining flat but cutting and laying down the shaped brick so that both edges of the side facing the converter lining come to lie against the lining, making this side a chord of the lining. Such a fit may be achieved with little trouble and is generally sufficient. However, one may consider, for certain embodiments, fitting the shaped brick more precisely to the converter lining, by making it polygonal or rounding it off.

The bottom plate with the refractory lining is preferably first attached mechanically to the converter in the known manner. The space between the bottom bricks and the converter lining, subsequently termed "edge area remaining free", "adjusting joint", or "seal", is, following this non-positive assembly of the bottom plate in the converter, lined conventionally with a refractory mass up to the height of the attrition bottom bricks, i.e. beside the bottom safety lining, and then the first shaped and fitting bricks may be built in. The refractory mass in the seal may also be rammed in up to a greater height, i.e. partly beside the wear bottom bricks as well. The shaped bricks and fitting bricks are then correspondingly shorter and built in, for example, only in the upper half of the adjusting joint. However, the length of the shaped bricks and fitting bricks preferably corresponds to the height of the wear bottom bricks.

The shaped bricks are laid down against the vessel lining, which in this area is cylindrical, in such a way that a rectangular cross-section preferably remains free between the shaped brick and the closest bottom brick. The fitting brick is then added in this space. The fitting brick may be composed of two or more refractory stone plates prefabricated in various wall thicknesses, and built in so as to fill in the space.

This inventive manner of lining makes it unnecessary to cut the fitting brick so as to fit precisely. However, it has been shown in practice that this space between the shaped bricks and bottom bricks usually shows deviations from the rectangular cross-section, both vertically amd horizontally, due to imprecisions of bricking when lining the bottom and the vessel. Therefore, the preferred execution of the inventive method consists in measuring the above-mentioned space between the shaped brick and the bottom brick and installing a fitting brick cut to size. The measurements may be determined at several heights on both sides of the space.

These measurements are preferably taken at two heights, near the upper and lower ends of the shaped brick or the space. The fitting brick is then cut, according to the measurements taken of the space, preferably as a whole or of two, or in special cases more, longitudinal pieces, using conventional cutting-off wheels or in particular diamond saws. The bricks are then built in.

If the space is wider at the bottom than at the top, a first fitting brick is preferably inserted which is shaped in such a way that it leaves an evenly wide space after being inserted. The first fitting brick is thus also wider at the bottom than at the top. A second fitting brick is then added in the remaining evenly wide space.

The adjusting joint is preferably lined with shaped and fitting bricks row by row, for example, by extending the bottom brick rows and/or at right angles thereto. The shaped bricks are first fixed to the side walling, the dimensions taken for the fitting brick and then the fitting brick inserted as a whole or in two or more parts. The shaped bricks may be fixed to the substantially cylindrical side walling either by adhesive or by refractory mortar, or else by mechanical clamping and/or holding devices between the shaped brick and the bottom brick. Useful clamping and holding devices are, for example, wedges, pressure springs and simple spreading devices. After the shaped bricks have been installed with the stated clamping and/or holding devices, the dimensions of the space are determined and the fitting brick is cut to size accordingly. The clamping and/or holding device is then removed and the fitting brick precisely cut to size is inserted. The fitting bricks may be laid dry without joint filler, but are preferably built in with commercial mortar.

A further feature of the invention is that the overall joint space in the walling of the bottom, which is built into the converter according to the inventive method, is kept small. The sum of the joint width between the bottom bricks, shaped bricks and fitting bricks should be between about 0.5 and 1.2% on the average, relative to these brick dimensions. One should try to achieve an approximately even distribution of these joints in the walling. Thus, the joint width, with or without mortar or adhesive filler, is 0.5 to 1.2 mm on the average in the direction of the rows of bricks in which the bricks are 100 mm wide, for example. Single joints with a width up to approx. 3 mm may be tolerated.

The converter bottom may be made either of one or of several refractory qualities of brick, according to the invention. It has proved useful, for example, to build the major portion of the converter bottom of low-iron, pitch-bound magnesite bricks and insert high-carbon magnesia qualities with a high proportion of molten sinter in the area close to the nozzles. For example, 50% to 90%, preferably 60% to 80%, of the overall bottom surface is lined with commercial pitch- or synthetic-resin-bound magnesite bricks of low-iron sinter or even Dead Sea periclase and with a residual carbon content of about 4 to 6%. In the area close to the nozzles, i.e. at least 50 mm around the outer blast pipe, special qualities of brick are used with a higher carbon content. These special bricks may be made of a mixture of at least 50% magnesite melt grain and pure magnesite sinter or even 100% melt grain. The carbon is added in the form of graphite, for example, natural flake graphite. The residual carbon content of these magnesite carbon bricks is between 10 to 25%, preferably 12 to 18%. The bond consists of pitch and/or synthetic resin.

Surprisingly enough, the converter bottoms installed according to the inventive method show considerably higher durability than comparable bottoms installed in the known manner. The inventive method makes it possible for the first time to achieve the same durability, with reliable operation, for the bottom provided with nozzles for introducing media, in particular nozzles for introducing oxygen with hydrocarbon protection, as for the converter lining. Thus there is no more change of bottom during the converter campaign. This results in an increase in the availability of the converter, involving advantages for operating practice, for example by increasing productivity in a steel making plant, and improving economy.

A further clear advantage of the inventive method over the known solutions lies in the wear characteristics of the refractory bottom linings. The wear profile is relatively even and exhibits in particular no areas prematurely in need of repair. Thus, the disadvantage of the known methods for installing converter bottoms, which show very premature wear in the area of the adjusting joint lined with refractory masses, could be completely overcome. For example, in the case of a bottom blowing steel making converter with an average operating temperature of 1670° C., the known seal lined with a pitch-bound magnesite mass had to be repaired three to ten times during one bottom campaign. This involves a loss of 6 to 25 hours of operating time, and the consumption of refractory repair mass is up to 20 t. When the inventive method for installing converter bottoms is used there are no longer any nonproductive times for the repair of the bottom seal, and repair mass is also saved.

The invention shall be described in more detail in the following with reference to non-limiting examples and drawings.

BRIEF DESCRIPTION OF THE DRAWINGS

The drawings show in FIG. 1 a horizontal section of partial areas of the bottom lining and converter wall lining with shaped and fitting bricks, and in FIG. 2 likewise a horizontal section of a partial area of the above-mentioned lining but with a different variant of the inventive bottom installation method with shaped and fitting bricks.

DESCRIPTION OF THE PREFERRED EMBODIMENT

Figure 1:
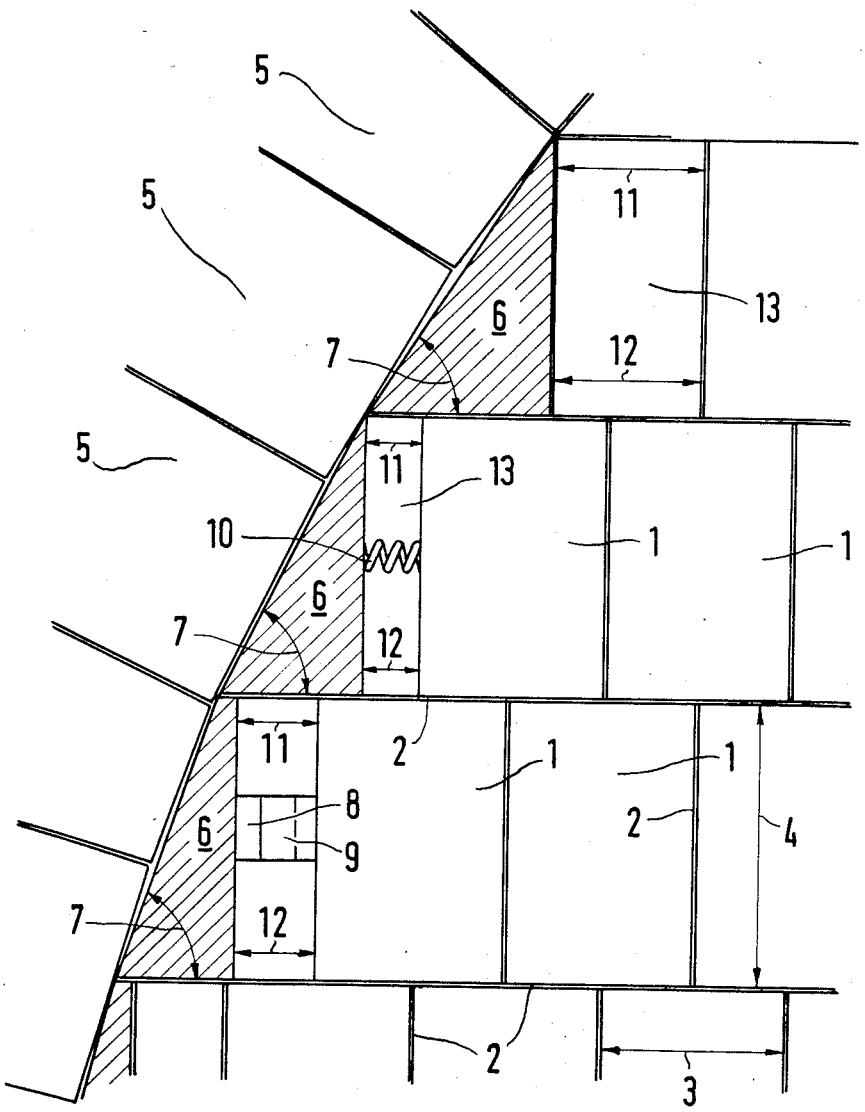

On a bottom plate which is not shown, there is a safety lining 150 mm high made of pitch-bound, low-iron magnesite bricks. The bottom bricks (1) are bricked up thereon with an average joint width (2) of 0.7 mm with an organic adhesive mortar containing approx. 70% magnesite powder as a filler. The bottom bricks have a rectangular cross-section with the dimensions (3) of 100 mm, (4) of 150 mm and a brick length of 900 mm. The lining of the bottom, including the drilling of the nozzle channels and the installation of the introduction nozzles with the corresponding pipework underneath the bottom plate, takes place outside the converter on a bottom plate in a vertical position in accordance with German Pat. No. 26 54 232. After the bottom has been assembled on the converter, the space (seal) between the bottom bricks (1) and the bricks (5) of the side wall of the converter is rammed down with a pitch-bound magnesite mass up to the height of the safety lining, i.e. up to the (1). Then the installation of the shaped bricks (6) begins—which are marked by hatching in FIGS. 1 and 2. These shaped bricks have an angle of adjustment (7) on the side facing the cylindrical side walling made of bricks (5). The angle of adjustment (7) varies depending on the position of the brick. It is approx. 90° in the brick position which cuts the center of the bottom, and then decreases in each adjacent position. But for each quadrant there is a shaped brick (6) with the same angle of adjustment (7).

The shaped bricks (6) are fixed to the side walling along their entire height, according to FIG. 1, either by wedges (8) and (9) or by at least two pressure springs (10) on the bottom brickside. The dimensions (11) and (12) are then determined at at least two different heights. The fitting brick (13) is cut to size in accordance with the dimensions (11) and (12) measured, and is inserted after holding devices (8), (9) or (10) have been removed. Shaped bricks (6) and fitting bricks (13) are installed using conventional mortar joints. However, one may also work with corresponding adhesives as used for laying the bottom bricks, or without any joint filler.

The first shaped bricks (6) are usually laid beside the middle layer of bottom bricks, each adjacent one being then placed in accordance with the bottom bricklayers. An overlapping procedure has proved useful for installing the shaped bricks (6) and the fitting bricks (13) in the entire area of the seal in as short a time as possible. This may be done, for example, by installing the shaped bricks (6) first in the first of the four quadrants, determining the dimensions (11) and (12) and beginning with the cutting of the fitting bricks. During the cutting time for the fitting bricks, the shaped bricks (6) may already be placed in the next quadrant and the cut fitting bricks (13) installed parallel thereto in the first quadrant. One continues with the lining accordingly.

Figure 2:
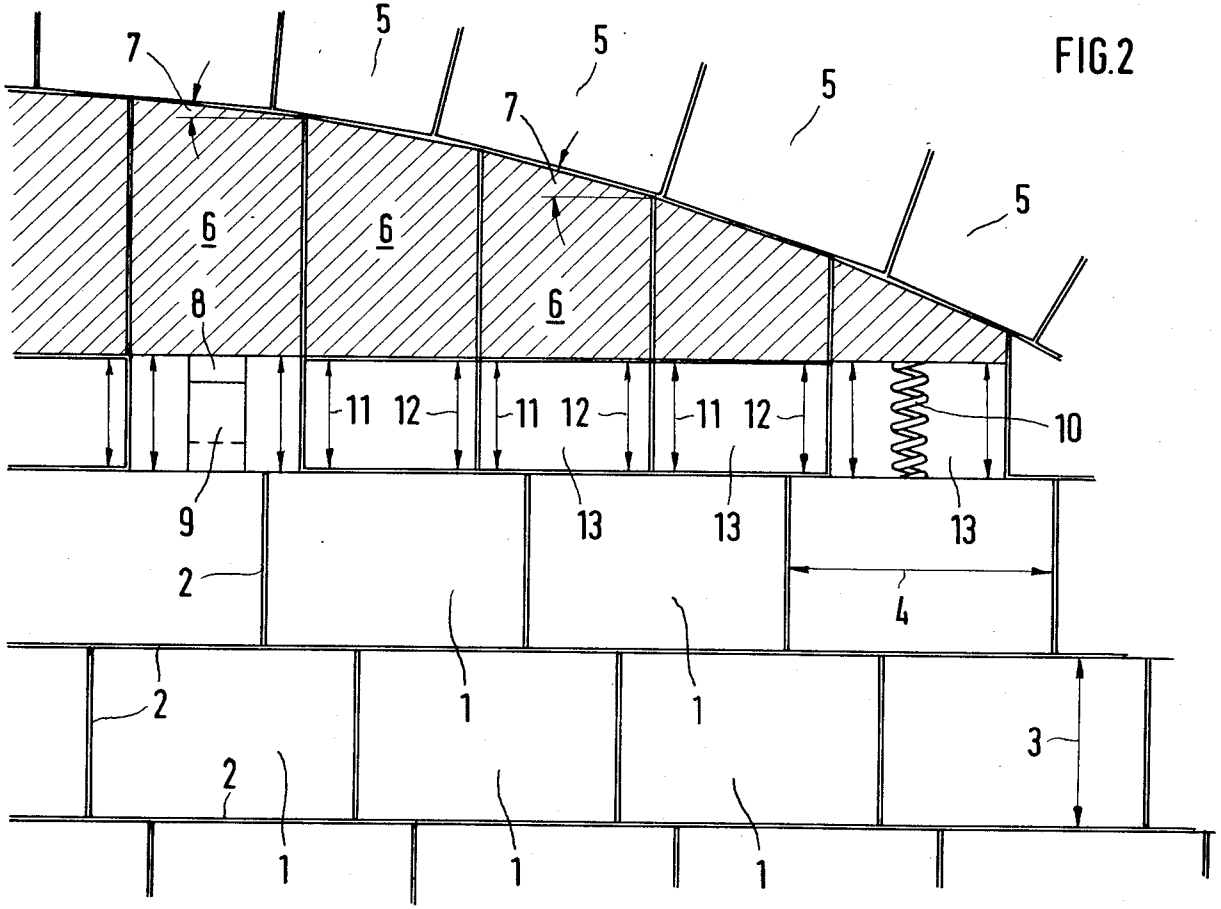

FIG. 2 shows a different inventive embodiment of the method. The working principle is basically the same as described for FIG. 1 but here the shaped bricks (6) and fitting bricks (13) are placed at right angles to the bottom brick layers formed by bottom bricks (1). It is intended by the invention to use both variants of installing the shaped and fitting bricks on the same bottom. The inventive method may of course be applied independently of the pattern of laying the bottom bricks. For example, FIG. 1 shows the installed bottom bricks (1) with a layer height (4), in this case 150 mm, while in FIG. 2 the same bottom bricks are turned by 90° with a layer height (3) of 100 mm.

The inventive method for installing converter bottoms may be modified in many ways; for example, it is independent of the dimensions of the bottom bricks and the bottom walling may also be fitted to the side wall of the converter with corresponding shaped bricks and fitting bricks over more than one bottom brick layer. Further, the shaped brick (6) may be formed with two or more different angles of adjustment (7) or have a rounded outer contour to allow for an optimal fit with the side walling.

According to the invention the method may be applied independently of the cross-section of the side walling to which the bottom is fitted. The wall lining in the area beside the bottom is generally cylindrical. However, other cross-sectional shapes are also possible, e.g. oval, rectangular or square. The inventive method of installing the bottoms is more simple in the special case of a rectangular or square shape of the wall lining beside the bottom. The shaped bricks then have a rectangular cross-section and may be replaced in particular cases, for example when the width of the seal is small, by fitting bricks which are usually larger than otherwise.

A 60 t-KMS converter is provided with 10 bottom nozzles and one top blowing nozzle in the upper converter cone. The introduction nozzles in the bottom are the known OBM nozzles made of two concentric pipes which are built into refractory material and for the protection of which hydrocarbons, in this case propane, are conducted through the annular gap. The molten iron is supplied through the central pipe of these nozzles with oxygen with and without a lime powder load and carboniferous fuels, such as finely ground coke. Nitrogen and argon may be conducted into the smelt as further media, and air and/or nitrogen flow(s) through the blast pipes during the holding times of the converter. Oxygen is supplied during the refining period via the top blowing lance, and this nozzle may be further operated with air or nitrogen.

The converter is usually lined with pitch-bound low-iron magnesite bricks. At the average tapping temperature of approx. 1675° C. the wear rates of the lining are approx. 1.5 mm/charge in the lower cone, approx. 1.2 mm/charge in the cylindrical portion and approx. 1.3 mm/charge in the taphole. The average durability of the converter is approx. 500 charges under the stated conditions.

The bottom is also lined for the most part with low-iron pitch-bound magnesite bricks and in the vicinity of the nozzles with magnesite carbon bricks whose residual carbon content is approx. 13%. In the known installation method previously used, the adjusting joint or seal is rammed down with a pitch-bound magnesite mass, or cast with the same mass, although with tar added, in the case of the second bottom. The wear rates for a bottom thus installed are between 2 and 3 mm/charge. Due to the premature wear of the seal, five repairs with about 10 t of tar dolomite mass altogether are necessary on the average per bottom campaign. Two or three bottoms are used during one converter campaign. The overall nonproductive time for repairs and change of bottom during one converter campaign is about 1 day on the average.

After the inventive method for installing the converter bottoms has been introduced, and using the same bottom lining, the bottom wear rate surprisingly decreases to 1.5 mm/charge on the average. There are no more repairs of the seal or changes of bottom during the converter campaign since only one bottom is necessary per converter campaign. The availability of the converter and its economy increase accordingly. The refractory costs could be drastically reduced using the inventive method. All bottoms installed according to the invention hold for one converter campaign.

The installation of the bottoms with the introduction nozzles for the coreactants also has very advantageous effects according to the invention in the case of the gasification of coal in an iron bath reactor with and without simultaneous melt reduction of iron ore. This is due in particular to the fact that repairs of the seal and the necessary inspections, both of which interfere with this continuously operated process, are no longer required.

What is claimed is:

1. A converter bottom for a converter vessel having vessel walls with a rounded interior liner contour and nozzles for the introduction of media comprising:

a bottom plate;

rectangular bottom bricks laid in such a manner as to cover the largest area of the bottom plate;

shaped bricks laid with the same orientation as the bottom bricks having one side fitted to and abutting said rounded interior liner contour of the vessel wall;

a free space exhibiting dimensions less than those of said bottom bricks and exceeding one joint width associated with said shaped bricks;

fitting bricks having different dimensions than the bottom bricks laid in the free space.

2. A converter bottom as in claim 1, wherein the shaped bricks are of such a geometry that a rectangular free space is formed between them and the adjacent bottom bricks.

3. A converter bottom as in claim 1, wherein the free spaces into which the fitting bricks are inserted has a width of more than 5 mm between the shaped brick and the adjacent bottom brick.

4. A converter bottom as in claim 1, wherein the joint width is between 0.5 and 3 mm.

5. A converter bottom as in claim 1, further comprising:

clamping or holding devices provided between the bottom bricks and the shaped bricks for fixing the shaped bricks to the converter vessel wall.

6. A converter bottom as in claim 1, wherein the dimensions of the fitting bricks are determined at two different heights.

7. A converter bottom as in claim 1, wherein the fitting bricks further comprise several parts.

8. A converter bottom as in claim 7, wherein the sum of the joints between the bottom bricks, the shaped bricks and the fitting bricks is set to be 0.5% to 1.2% of the brick dimensions.

9. A converter bottom as in claim 1, wherein the shaped bricks and fitting bricks are installed in the direction of the bottom brick rows and at right angles thereto.

10. A converter bottom as in claim 1, wherein 50% to 90% of the overall bottom surface is lined with low-iron pitch-bound magnesite bricks and the vicinity of the nozzles for the introduction of media is lined with magnesite carbon bricks.

11. A method for installing a converter bottom on a bottom plate for a converter vessel having vessel walls with a rounded interior liner contour and nozzles for introduction of media comprising the steps of:

laying rectangular bottom bricks in such a manner as to cover the largest area of the bottom plate;

laying shaped bricks aligned with the same orientation as the bottom bricks having one side fitted to and abutting the interior liner contour of the vessel wall, said shaped bricks being of a size such that a free space exhibiting dimensions less than those of said bottom bricks and exceeding one joint width remains adjoining an associated bottom brick;

inserting fitting bricks having different dimensions than the bottom bricks in the free space.

12. A method for installing a converter bottom as in claim 11, wherein the shaped bricks are of such a geometry when laid that a rectangular free space is formed between them and an adjacent bottom bricks.

13. A method for installing a converter bottom as in claim 11, wherein the free spaces into which the fitting bricks are inserted has a width of more than 5 mm between the shaped brick and the adjacent bottom brick.

14. A method for installing a converter bottom as in claim 11, wherein the joint width is between 0.5 and 3 mm.

15. A method for installing a converter bottom as in claim 11, wherein the bottom bricks are laid on the bottom plate before the bottom is inserted into the converter.

16. A method for installing a converter bottom as in claim 11, further comprising the step of fixing the shaped bricks to the converter vessel wall by clamping or holding devices provided between the bottom bricks and the shaped bricks.

17. A method for installing a converter bottom as in claim 11, wherein the dimensions of the fitting bricks are determined at two different heights.

18. A method for installing a converter bottom as in claim 11, wherein the fitting bricks comprise several parts.

19. A method for installing a converter bottom as in claim 18, wherein the sum of the joints between the bottom bricks, the shaped bricks and the fitting bricks is set to be 0.5% to 1.2% of the brick dimensions.

20. A method for installing a converter bottom as in claim 11, wherein the shaped bricks and fitting bricks are installed in the direction of the bottom brick rows and at right angles thereto.

21. A method for installing a converter bottom as in claim 11, wherein 50% to 90% of the overall bottom surface is lined with low-iron pitch-bound magnesite bricks and the vicinity of the nozzles for the introduction of media is lined with magnesite carbon bricks.

* * * * *